US005249602A

United States Patent [19]

Sándor et al.

[11] Patent Number: 5,249,602

[45] Date of Patent: Oct. 5, 1993

[54] ARRANGEMENT FOR FLOW CONTROL OF GASEOUS AND LIQUID MEDIA, PARTICULARLY AIR

[76] Inventors: László23, Berze Nagy János út Sándor, Gyöngyös, Hungary; Zoltán Szalay, 48, Arnyas utca, Törökbálint, Hungary, 2045

[21] Appl. No.: 778,891

[22] PCT Filed: Jun. 29, 1990

[86] PCT No.: PCT/HU90/00043

§ 371 Date: Dec. 23, 1991

§ 102(e) Date: Dec. 23, 1991

[87] PCT Pub. No.: WO91/00480

PCT Pub. Date: Jan. 10, 1991

[30] Foreign Application Priority Data

Jul. 4, 1989 [HU] Hungary ..... 3362/89
Jul. 4, 1989 [HU] Hungary ..... 3364/89

[51] Int. Cl.[5] ..... F24F 13/062

[52] U.S. Cl. ..... 137/625.35; 454/274; 454/334

[58] Field of Search ..... 137/601, 625.33; 454/274, 323, 334

[56] References Cited

U.S. PATENT DOCUMENTS 2,269,031 1/1942 MacArthur ..... 137/625.33 X
2,586,997 2/1952 Schach ..... 137/601
2,974,680 3/1961 Krenttner ..... 137/601 X
4,359,934 11/1982 Musacchia ..... 454/274
4,383,477 5/1983 Nilsson et al. ..... 454/274
4,535,811 8/1985 Wood et al. ..... 137/601
4,665,806 5/1987 Martin ..... 454/334 X
4,690,372 9/1987 Thiebaud ..... 454/334 X
4,715,268 12/1987 Tanner ..... 454/334 X
4,779,518 10/1988 Artwick et al. ..... 454/353

*Primary Examiner*—Stephen M. Hepperle
*Attorney, Agent, or Firm*—Young & Thompson

[57] ABSTRACT

The invention relates to an arrangement for controlling the flow of gaseous and liquid media, particularly air, comprising of a housing, a number of movable closing members shutting off in closed position the internal cross-sectional area of said housing and an actuating mechanism connected to said movable closing members. The essence of the invention lies in that the arrangement comprises fixed closing members (5) co-acting with movable closing members (4), said closing members constituting a stationary grid (15) containing concentric rings, further said movable closing members (4) are designed to form concentric rings constituting together a movable grid (14) displaceable in axial direction, wherein said ring-shaped closing members (4, 5) both of the stationary grid (15) and the movable grid (14) in a position forced to lean against each other fit to each other so as to shut off the passage of flow of the medium, further the movable grid (14) is connected to an actuating mechanism (11) effective in axial direction.

8 Claims, 6 Drawing Sheets

ARRANGEMENT FOR FLOW CONTROL OF GASEOUS AND LIQUID MEDIA, PARTICULARLY AIR

The present invention relates to an arrangement for controlling flow of gaseous and liquid media, of air in particular, comprising of a housing, a number of movable closing elements shutting off the internal cross-sectional area of said housing and an actuating mechanism coupled with said movable closing members.

For the purpose of controlling the flow of gaseous and liquid media and of air in particular the known louvre arrangements contain strip-like closing members rotatably mounted at one end of their length. On closing of the adjustable flow control arrangement each closing member is moved to lean against the adjacent similar element and closes arranged transversely with respect to the flow path of the medium and the path of flow of the medium. In opened position the closing members are adjusted into the direction of flow by moving them away from each other. The closing members of such type of flow control arrangements are kinematically coupled and remain substantially in plano-parallel position with respect to each other throughout their entire movement, the actuating mechanism causing simultaneous angular displacement of closing members. The actuating mechanism may either be operated manuallay, or by means of a pulling magnet, electric motor, actuating cylinder or some other suitable mechanism. Such flow control arrangements are commercially available, their construction being described under the entry word "air duct" in Vol. II of the Müszaki Lexikon (Technical Encyclopaedia) published by the Akadémiai Kiadó (Publishing House of the Academy of Sciences, Budapest, 1984) with reference to FIGS. 8 and 9 on page 830.

The deficiencies of the above known arrangement lie on the one hand in the necessity of using a separate operating mechanism which has to be controlled. Thereby the costs rise on the one hand and additive power is consumed on the other hand. A further drawback lies in that the shuttingoff capability is usually insufficient and unsuitable for obtaining reliable shutting.

The object aimed at by the present invention is to provide a flow control arrangement that can be shut off satisfactorily and reliably.

Another object of the invention is to provide for a flow control arrangement that can be controlled by means of a simple actuating mechanism.

A further aim of the invention is to provide a flow control arrangement requiring no additional control means mechanism and auxiliary power.

Another aim is to provide for a flow control arrangement that can be integrally built with a fan and which is adequately protected against accidents by protecting the fan from reaching into it.

The aim set is achieved by a flow control arrangement for the flow control of gaseous and liquid media, particularly air, comprising a housing, a number of movable closing members covering in shut-off position in crosswise direction the internal cross-sectional area of said housing, an actuating mechanism coupled to said movable closing members. In accordance with the invention, the arrangement is provided with fixed closing members coacting with movable closing members, said fixed members constituting a stationary grid incorporating concentric rings. Said movable closing members are designed to form concentric rings constituting an axially displaceable movable grid assembly. When pressed against each other, ring-shaped closing members of the stationary and the movable grid assembly tightly fit to each other, so as to shut off the flow path of the medium. The moving grid is linked up with an actuating mechanism effective in axial direction, pressing the stationary and movable grids against each other when shut off, and moving them apart when opened.

In a preferred embodiment of the invention the louvre elements are conic sections, i.e. essentially part of the mantle of a truncated cone with the required thickness. Of coursse, the cone surface can be modified, i.e. streamlined in order to improve the flow resistance of medium.

With a further advantageous embodiment of the invention the movable grid is provided with a hub supported by a rotatable shaft of the actuating mechanism and displaceable along a helical screw-thread.

By means of this arrangement the rotation of the shaft can be easily transformed into axial movement of the movable grid, i.e. that of the hub carrying the movable grid.

With another preferred embodiment of the invention the actuating mechanism is an electric rotary machine or a pulling magnet. The electric rotary machine itself can be used with advantage as a pulling magnet, if provided with an axially displaceable rotor.

A further advantageous embodiment of the invention is that the arrangement comprises a movable grid which is attached to or integrated with a paddle-wheel.

Thereby the flow control assembly can be opened (or closed) simultaneously with the starting of the electric rotary machine driving the paddle-wheel.

In a further preferred embodiment of the flow control assembly complying with the invention the movable grid is guided in the housing axially displaceably and nonrotatingly. This arrangement offers special advantage, when the hub is rotatable on the shaft along a helical curve, since rotation of the shaft resulst in an axial displacement of the unrotatably movable grid.

The invention, its further characteristic features and advantageous properties will be described in detail with reference to the embodiments presented as examples in the attached drawings. In the drawings.

Figure 1:
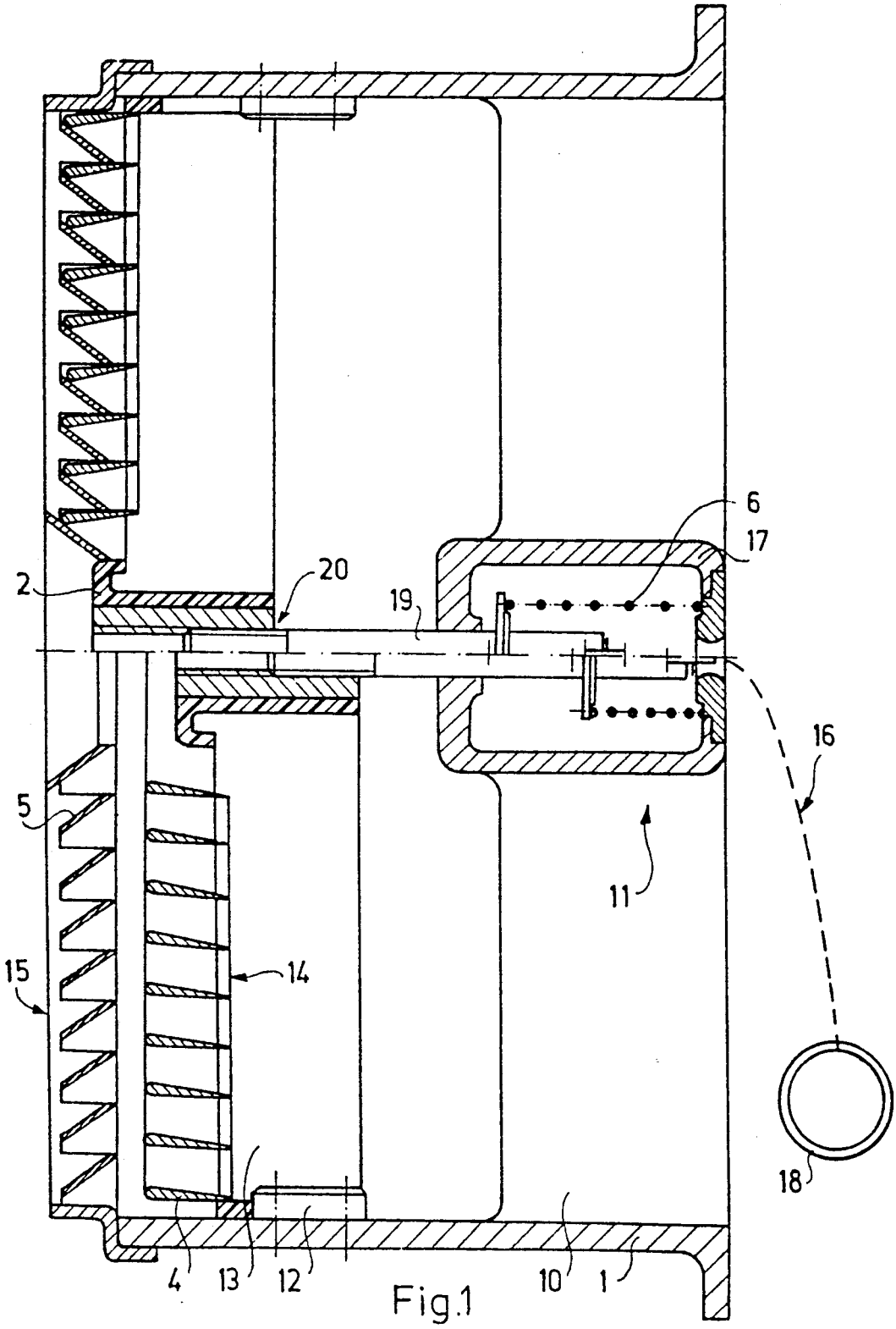
FIG. 1 is the manually operated embodiment of the flow control assembly complying with the invention.

The invention relates to a flow control assembly suitable for controlling the flow of gaseous and liquid media, such as air in particular, to be described in the following with reference to the flow control assemblies shown in the drawings. FIG. 1 is a manually operated variant of the flow control assembly complying with the invention, shown in closed position in the upper half and in open position in the lower half of the figure. The flow control assembly comprises a casing 1, movable closing members 4 arranged transversally to the flow of the medium and shutting off in closed position the internal cross-sectional area of said casing 1 and an actuating mechanism 11 connected to the movable closing members 4. Further, the flow control assembly is provided with fixed closing members 5 co-acting with said movable closing members 4, said fixed closing members 5 constituting a stationary grid 15 containing concentric rings and supported by diametral ribs. The movable louvre elements 4 are concentric rings, constituting an axially displaceable movable grid assembly 14 braced with diametral ribs 13. In closed position, the annular loubre elements 4, 5 of stationary grid 15 and movable grid 14 fit to each other, blocking thereby the flow path of the medium, as shown in the upper half of FIG. 1. Said movable grid 14 is connceted to an actuating mechanism 11 effective in axial direction.

The actuating mechanism 11 incorporates a manual pulling device 18 and a chain 16 coupled to the shaft 19 held in closing direction by a prestressed spring 6. One end of the shaft 19 is connected through a helical groove 20 to a hub 2 carrying said movable grid 14 . The moving grid 14 is guided in casing 1 permitting axial movement, said grid being secured against angular displacement by a guide cam 12 fixed to said casing 1. The other end of shaft 19 distal to s id hub 2 is guided also in axially slidable way in a socket 17 housing a spring 6, said socket 17 being braced by ribs 10 to the mantle of housing 1.

The embodiment of the flow control arrangement complying with the invention as shown in FIG. 1 operates in the following way:

The movable grid 14 in its closed position shown in the upper half of the figure is pressed against the stationary grid 15 by spring 6 through hub 2 and shaft 19, blocking thereby the passage of flow of the medium by causing the movable and stationary closing members 4, 5 to fit tightly to each other. By means of the pulling device 18 through the interposed chain 16 said shaft 19 can be shifted axially against the thrust of spring 6 into the position shown in the lower half of the figure. In that position the closing members 4 of the movable grid 14 are withdrawn from the closing members 5 of said stationary grid 15, opening thereby the flow gap of the air between closing members 4 and 5. It is easy to see that even slight axial displacement of said elements will result in a relatively large cross section free for the medium to pass through. Though both the movable grid 14 and the stationary grid 15 remain in the path of flow, the drag caused by said grids can be kept at a low level by appropriate design of the cross-sectional shape of closing members 4 and 5, while in closed position, as result of the conical surfaces of closing members 4 and 5 an effective shutting is achieved.

Since the hub 2 is fixed on shaft 19 by thread 20, loosening during operation that would cause angular displacement is prevented by guide cam 12 reaching from the inner mantle surface of casing 1 toward the inside, said guide cam 12 being coupled with the slot provided in direction of the generatrix of the mantle linked with rib 13 supporting said closing members 14.

Of course, instead of manual actuation, also a pulling magnet can be built into said socket 17.

Figure 2:
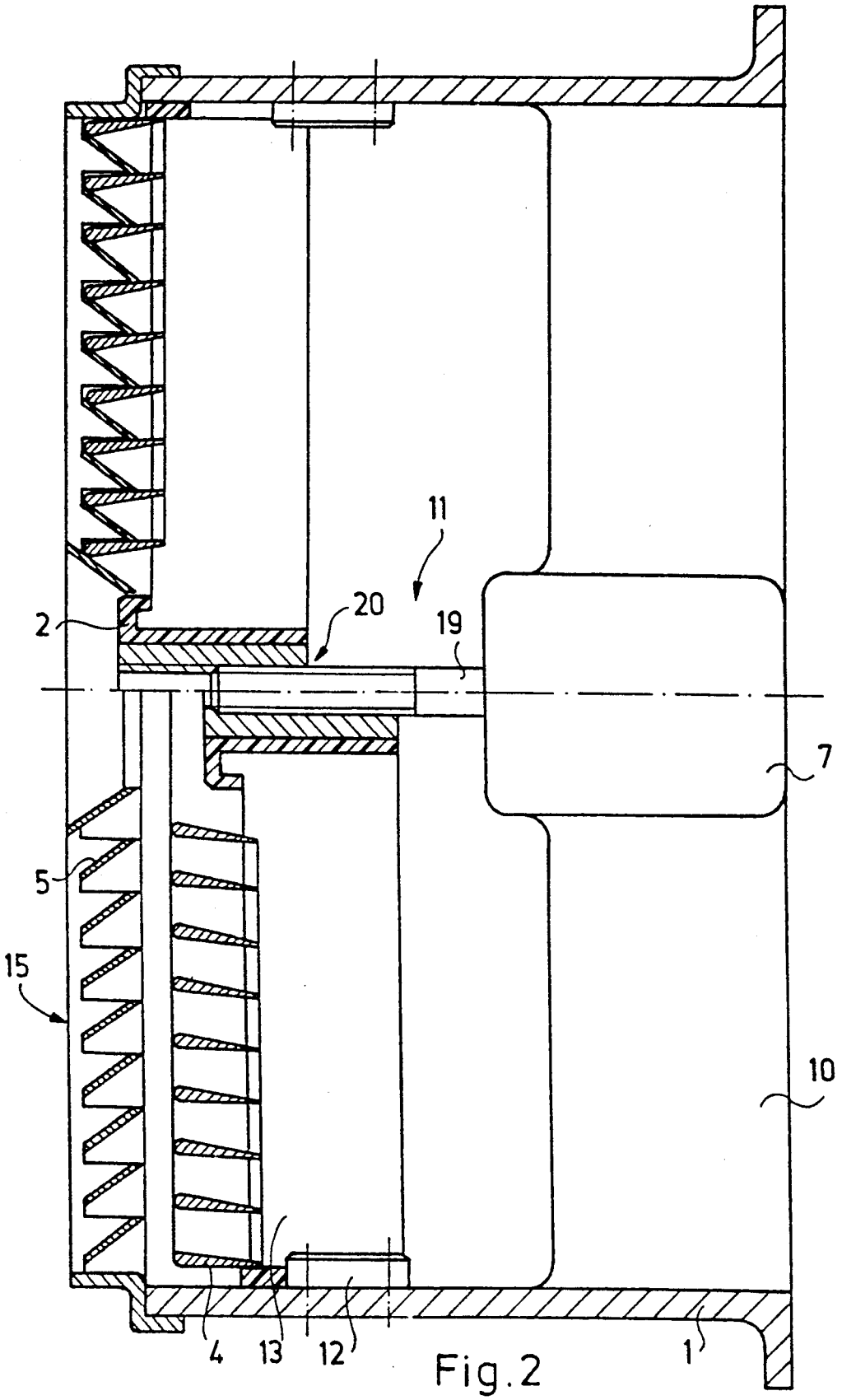
FIG. 2 is an embodiment of the flow control assembly complying with the invention, operated by means of a pulling magnet.

FIG. 2 is the motor operated version of the flow control assembly according to the invention, shown in closed state in the upper half and in open state in the lower half of the figure. The only deviation from the variant shown in FIG. 1 is that said shaft 19 is coupled with an electric rotary machine 7 or said shaft 19 is common with that of the motor 7. Said thread 20 and said rotary machine 7 cinstitute together the actuating mechanism 11.

The embodiment of the flow control mechanism according to the invention, as shown in FIG. 2, operates in the following way:

Shaft 19 is rotated by said electric motor 7 and depending on the seinse of rotation causing through the screw thread 20 an axial displacement of hub 2 and that of the movable grid 14 attached to it since said grid cannot rotate. Depending on the pitch of thread 20 a force of considerable magnitude can be exerted, ensuring safe shutting of the arrangement. To avoid development of excessively high forces it is advisable provide for a prevention, e.g. to insert a switch into the electric circuit of the rotary machine 7 causing the tripping of the motor under the effect of a force exceeding a preset value.

Figure 3:
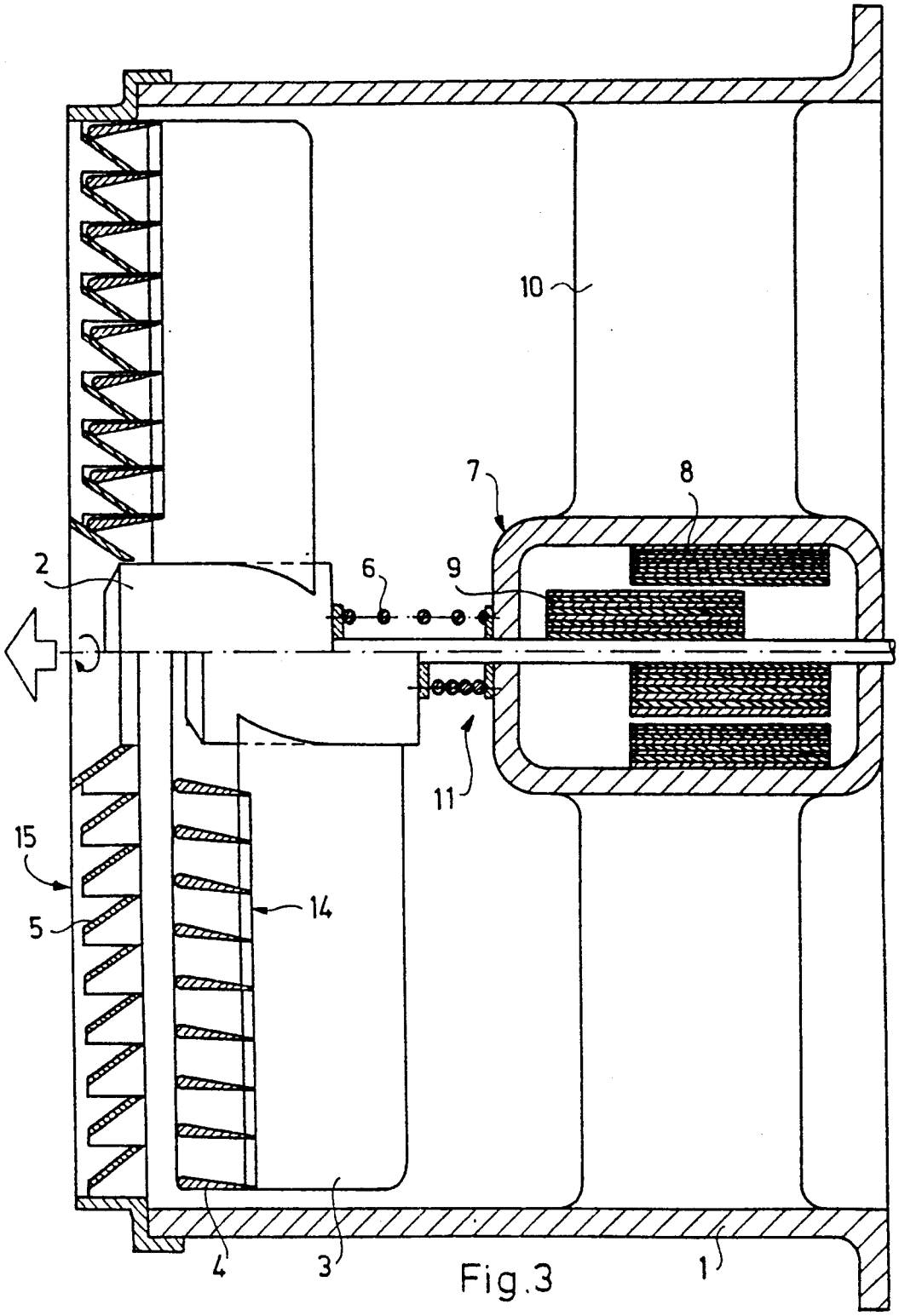
FIG. 3 is an embodiment of the flow control assembly complying with the invention, operated by an electric rotary machine having an axially displaceable rotor, combined with an axial fan.

FIG. 3 is the variant of the flow control assembly according to the invention which is actuated by an electric motor provided with an axially displaceable rotor 9 and combined with an axial fan. In the upper half of the figure the rotary machine 7 is at standstill, in its lower half it is in operating position. Characteristic of this combination is the movable grid 14 integrally built with a paddle-wheel 3, where the closing members 4 are held in concentric position within said movable grid by the blades of said paddle-wheel 3. The paddle-wheel 3 and the movable grid 14 rigidly connected with each other are linked with the common hub 2 which, in turn, is fixed to the shaft of electric rotary machine 7. The actuating mechanism 11 is built up as follows: the moving part of the rotary machine 7 is slidable in axial direction and in stationary position rotor 9 is withdrawn from the stator 8 by spring 6 located between rotary machine 7 and hub 2 to a distance equal to 10 to 40 per cent of the length of the rotor. The movable grid 114 and the stationary grid 15 is kept in shut position by the force of spring 6.

The embodiment of the flow control arrangement according to the invention and corresponding to FIG. 3 operates in the following way:

On switching on, the rotary machine acts as a pulling magnet, causing displacement of the movable grid 14 attached to hub 2 in opening direction. Thus the closing members 4 and 5 recede from each other, and the rotary machine starts rotating, causing the paddle-wheel 3 and the movable grid 14 fixed thereto to rotate. Under the effect of the tension of spring 6 rotor 9 of the rotary machine 7 would never be capable of assuming the magnetically otimum position, since it is moved out from this position by the spring 6—however small this discrepancy is. The efficiency of the rotary machine 7 is thereby somewhat reduced. This can—at least partly—be compensated by the aerodynamical force acting on the paddle-wheel 3, if the direction of air flow agress with that of the hollow arrow shown on the left-hand side of the drawing. On stopping the rotary machine, spring 6 presses the movable closing members against the stationary closing members 5, the mutual friction bringing the mechanism to a halt. Under the effect of this braking friction the closing members 4, 5 are ground together, further improving thereby the sealing capability of the assembly. Expediently, the material of the closing members 4 is chosen to be harder than that of the stationary grid 15 since the latter wearing off more rapidly is the one that can be replaced easier.

Figure 4:
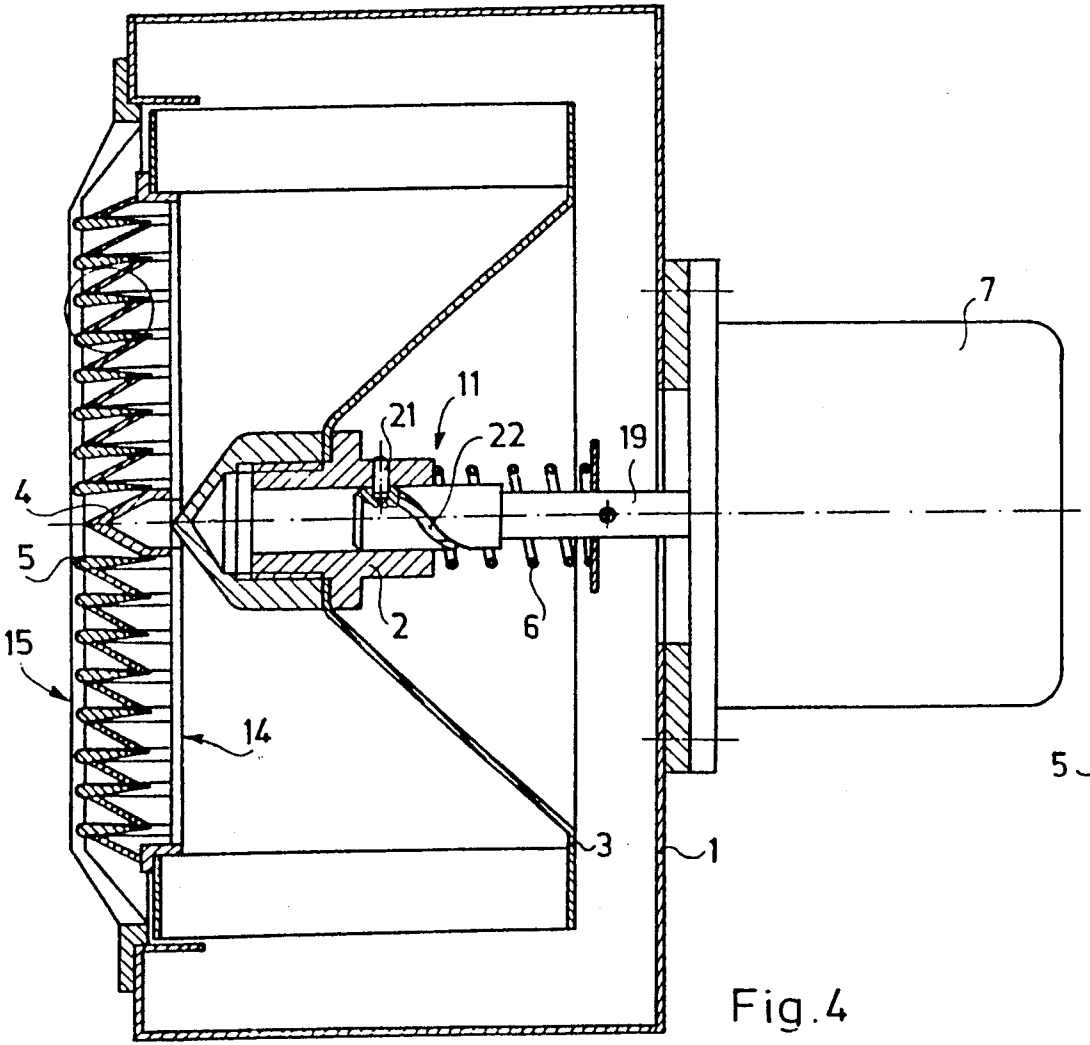
FIG. 4 is an embodiment of the flow control assembly, complying with the invention, in closed state for being opened by means of a paired key and groove and combined with a radial-flow fan.
Figure 6:
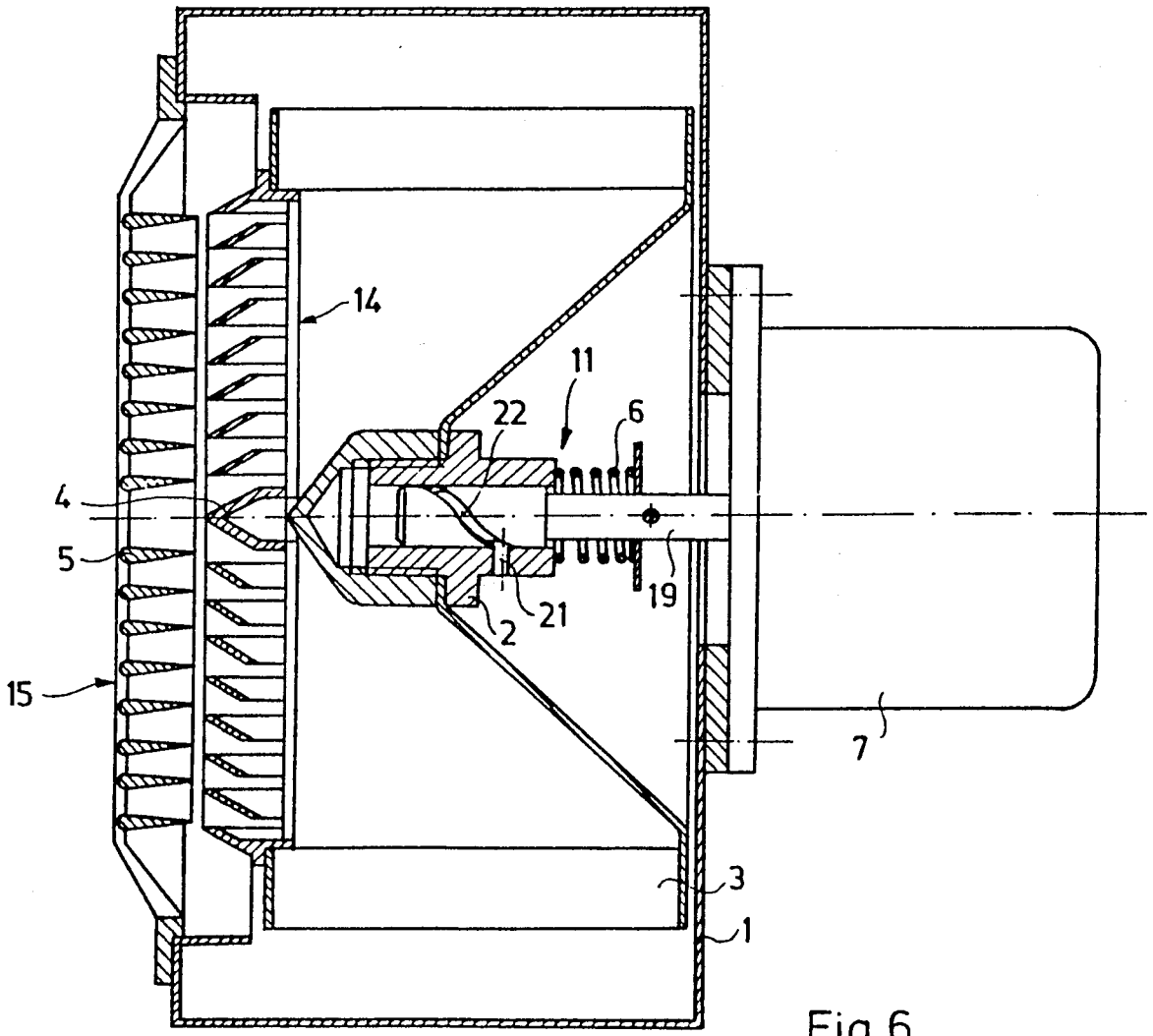
FIG. 6 is the flow control assembly shown in FIG. 4 in open state.

In FIG. 4 of the embodiment of the invention is illustrated where for the opening of the flow control mechanism a pin sliding in a helical groove is employed, said mechanism is combined with a radial-flow fan and shown in closed position, and in FIG. 6 the same flow control mechanism is shown in open position. This embodiment differs from the former variant—on the one hand—in the otherwise well-known design of the paddle-wheel 3, and—on the other hand—in the construciton of the actuating mechanism 11 of the flow control assembly. In the shaft 19 of the rotary machine 7 a helical groove is provided for slidably receiving a pin 21 fitted into the hub of the paddle-wheel 3 pulled over said shaft 19.

Said paddle-wheel 3, or particularly the movable grid 14 attached to the paddle-wheel 3 is forced into closed position by said spring 6.

The embodiment of the flow control mechanism complying with the invention shown in FIGS. 4 and 6 operates in the following way:

In rest position the movable grid 14 pressed against said stationary grid 15 is prevented from angular displacement with respect to the former by the friction arising between them. Therefore, on starting the rotary machine, hub 2 and paddle-wheel 3 linked up with the latter, as well as the movable grid 14 are moved against spring 6 toward the rotary machine 7 by the helical groove 22 provided in rotated shaft 19 through pin 21. After ceasing of friction pin 21 keeps moving along the helical groove 22 under the braking effect of the air and the force of inertia, i.e. the opening action continues. On stopping operation of the rotary machine 7 the closed position of the flow control assembly is restored by the action of spring 6. The pitch steepness of the helical groove 22 and the characteristic of spring 6 have to be determined in relation with the braking effect of the air acting on the paddle-wheel 3.

Figure 5:
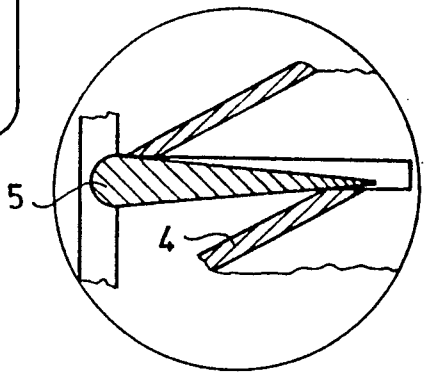
FIG. 5 is an enlarged detail V of the flow control assembly shown in FIG. 4.

A possible embodiment of the match between movable and stationary closing members 4, 5 is shown on enlarged scale in FIG. 5. The pressure difference acting on the flow control assembly in its closed position will exert higher effect on closing members 4 or 5, on which of the two exhibits a larger effective surface projected to the plane perpendicular to the axial direction, i.e. which is of larger conicity. This circumstance has to be taken into account when designing the opening and closing process and the direction of air-flow.

Figure 7:
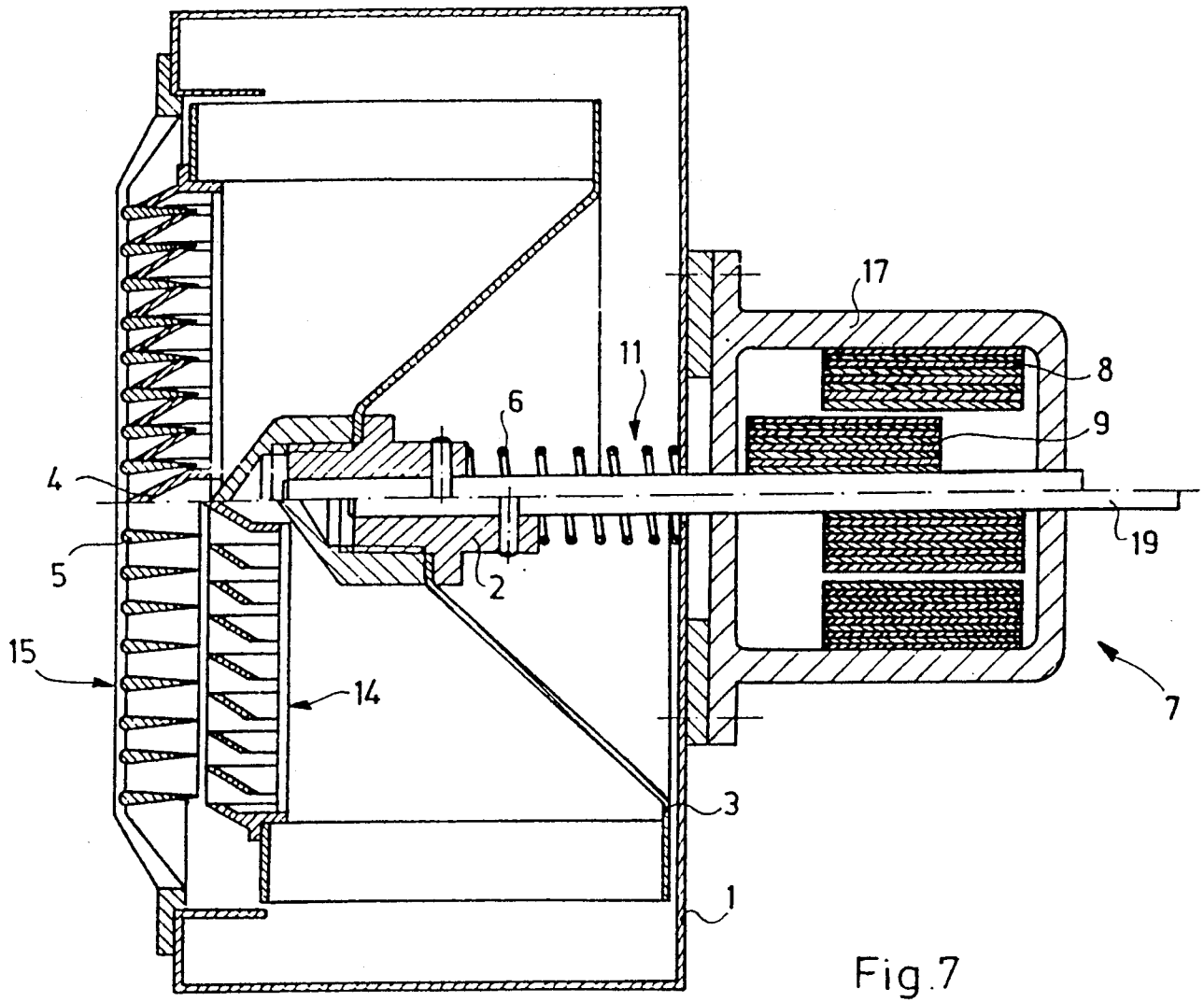
FIG. 7 is an embodiment of the flow control assembly complying with the invention and similar to that shown in FIG. 4, combined with an electric rotary machine fitted with an axially displaceable rotor.

In FIG. 7 is an embodiment of the flow control assembly according to the invention, similar to that of FIG. 4 incorporating an electric rotary machine having a rotor displaceable in axial direction. In the upper part of the figure the rotary machine 7 is at standstill, the flow control assembly is in shut-off position, whereas in the lower part of the figure the rotary machine 7 is in running state, and the flow control assembly is in open position. Its operation is, in essence, the same as equal to that of the embodiment shown FIG. 3.

We claim:

1. Arrangement for controlling the flow of gaseous and liquid media, particularly air, comprising of a housing, a number of movable closing members shutting off in closed position the internal cross-sectional area of said housing and an actuating mechanism connected to said movable closing members, characterized by comprising fixed closing members (5) co-acting with movable closing members (4), said closing members constituting a stationary grid (15) containing concentric rings, further said movable closing members (4) are designed to form concentric rings constituting together a movable grid (14) displaceable in axial direction, wherein said ring-shaped closing members (4, 5) both of the stationary grid (15) and the movable grid (14) in a position forced to lean against each other fit to each other so as to shut off the passage of flow of the medium, further the movable grid (14) is connected to an actuating mechanism (11) effective in axial direction.

2. The flow control assembly as claimed in claim 1, characterized in that said closing member s (4, 5) being conical sections.

3. The flow control assembly as claimed in claim 1, characterized in that said movable grid (14) being provided with a hub (2), said hub (2) is displaceably guided in a helical groove provided in the rotatable shaft (19) of the actuating mechanism (11).

4. The flow control assembly as claimed in any of claim 1, characterized in that said actuating mechanism (11) contains an electric rotary machine.

5. The flow control assembly as claimed in any of claim 1, characterized in that said actuating mechanism (11) comprising a pulling magnet.

6. The flow control assembly as claimed in claim 5, characterized in that said pulling magnet being constituted by an electric rotary machine (7) provided with an axially displaceable rotor (9).

7. The flow control assembly as claimed in any of claim 1, characterized in that said movable grid (14) is attached to a paddle-wheel (3) or is integrated therein.

8. The flow control assembly as claimed in claim 1, characterized in that said movable grid (14) is guided in the housing (1) in axially displaceable way and prevented from rotating with respect to the housing (1).

* * * * *

UNITED STATES PATENT AND TRADEMARK OFFICE

CERTIFICATE OF CORRECTION

PATENT NO. : 5,249,602

DATED : October 5, 1993

INVENTOR(S) : László SÁNDOR et al.

It is certified that error appears in the above—identified patent and that said Letters Patent is hereby corrected as shown below:

On the title page, Item 76, change the name of the first inventor, from "László23, Berze Nagy János út Sándor" to --László Sándor--.

Signed and Sealed this

Twenty-ninth Day of March, 1994

Bruce Lehman

*Attest:*

BRUCE LEHMAN

*Attesting Officer*

*Commissioner of Patents and Trademarks*